US007872555B2

(12) United States Patent
Kitamura et al.

(10) Patent No.: US 7,872,555 B2
(45) Date of Patent: Jan. 18, 2011

(54) UNDULATOR

(75) Inventors: Hideo Kitamura, Hyogo (JP); Toru Hara, Hyogo (JP); Takashi Tanaka, Hyogo (JP); Tsutomu Kohda, Osaka (JP); Yutaka Matsuura, Osaka (JP)

(73) Assignees: Hitachi Metals, Ltd., Tokyo (JP); Riken, Saitama (JP)

( * ) Notice: Subject to any disclaimer, the term of this patent is extended or adjusted under 35 U.S.C. 154(b) by 1175 days.

(21) Appl. No.: 10/597,352

(22) PCT Filed: Jan. 18, 2005

(86) PCT No.: PCT/JP2005/000525

§ 371 (c)(1),
(2), (4) Date: Aug. 31, 2006

(87) PCT Pub. No.: WO2005/072029

PCT Pub. Date: Aug. 4, 2005

(65) Prior Publication Data

US 2008/0231215 A1 Sep. 25, 2008

(30) Foreign Application Priority Data

Jan. 23, 2004 (JP) ..... 2004-015878

(51) Int. Cl.
*H01F 7/02* (2006.01)

(52) U.S. Cl. ..... 335/306; 335/296; 372/37; 372/74; 315/501

(58) Field of Classification Search ..... 335/306, 335/296, 299; 315/501, 503, 505, 507; 372/2, 372/37, 73, 74
See application file for complete search history.

(56) References Cited

U.S. PATENT DOCUMENTS 4,523,168 A * 6/1985 Emanuelson et al. ..... 335/296
4,912,737 A * 3/1990 Ohsuka et al. ..... 378/43

(Continued)

FOREIGN PATENT DOCUMENTS

JP 7-159543 6/1995

(Continued)

OTHER PUBLICATIONS

P.M. Stefan, et al., Initial results from an in-vacuum undulator in the NSLS X-ray ring, Journal of Synchrotron Radiation, 1998, 5, 417-419.

(Continued)

*Primary Examiner*—Haissa Philogene
(74) *Attorney, Agent, or Firm*—Knobbe Martens Olson & Bear LLP

(57) ABSTRACT

An undulator comprises a first magnetic circuit (11) for forming a periodic magnetic field, a first support body (21) for supporting the first magnetic circuit (11), a second magnetic circuit (12) arranged opposite to the first magnetic circuit (11), for forming a periodic magnetic field, a second support body (22) for supporting the second magnetic circuit (12), a space (13) formed between the oppositely arranged first magnetic circuit (11) and the second magnetic circuit (12), for passing an electron beam, a vacuum chamber (1) for vacuum-sealing the first magnetic circuit (11) and the second magnetic circuit (12), and a refrigerant passing tube (30) for cooling a permanent magnet (m) constituting the first magnetic circuit (11) and the second magnetic circuit (12) below the room temperature.

15 Claims, 12 Drawing Sheets

U.S. PATENT DOCUMENTS

| | | | | |
|---|---|---|---|---|
| 4,977,384 | A | 12/1990 | Tatchyn et al. | |
| 5,410,558 | A | 4/1995 | Hachett | |
| 6,573,817 | B2 * | 6/2003 | Gottschalk | 335/306 |
| 6,858,998 | B1 * | 2/2005 | Shenoy et al. | 315/503 |
| 2003/0122090 | A1 | 7/2003 | Tsukihara et al. | |

FOREIGN PATENT DOCUMENTS

| | | | |
|---|---|---|---|
| JP | 2000-206296 | A | 7/2000 |
| JP | 2001-143899 | | 5/2001 |
| JP | 2002-75699 | A | 3/2002 |
| JP | 2002-246199 | A | 8/2002 |
| JP | 20003-197144 | | 7/2003 |

OTHER PUBLICATIONS

J. Chavanne, et al., In-Vacuum Undulators at ESRF, Proceedings of the 2003 Particle Accelerator Conference, ESRF, F38043, Grenoble France, 253-255.

Supplementary European Search Report issued by European Patent Office on Jan. 14, 2010 for couterpart European Patent Application No. 05703762.4.

T. Hara, et al., In-vacuum undulators of SPring-8, Synchrotron Radiation (1998). 5, pp. 403-405.

Shigeru Yamamoto, et al., Construction of an in-vacuum type undulator for production of undulator x rays in the 5-25 keV region, Rev, Sci. Instrum. vol. 63, No. 1, Jan. 1992, pp. 400-403.

* cited by examiner

FIG.14

| No. | Material name | Nominal value | | | Measured value | | | | | | Theoretical limitation |
|---|---|---|---|---|---|---|---|---|---|---|---|
| | | | | | RT | | Low temperature | | | Br ratio | |
| | | Temperature | Br (T) | iHc (MA/m) | Br (T) | iHc (MA/m) | Temperature | Br (T) | iHc (MA/m) | (Low temperature/RT) | Br (T) |
| 1 | NEOMAX50BX | RT | 1.39-1.45 | >1.1 | 1.44 | 1.2 | 150K | 1.58 | 2.9 | 1.10 | 1.61(RT)<br>1.84(LNT)<br>1.85(LHeT) |
| 2 | NEOMAX48H | | 1.36-1.42 | >1.3 | 1.38 | 1.3 | 145K | 1.51 | 3.4 | 1.10 | |
| 3 | NEOMAX44H | | 1.30-1.36 | >1.3 | 1.36 | | 150K | 1.48 | | 1.09 | |
| 4 | NEOMAX35EH | | 1.17-1.25 | >2.0 | 1.18 | 2.0 | 128K | 1.28 | 4.5 | 1.09 | |
| 5 | NEOMAX27VH | | 1.02-1.10 | >2.9 | 1.12 | 2.5 | 128K | 1.19 | 4.8 | 1.07 | |
| 6 | NEOMAX53CR | RT<br>LNT<br>LHeT | 1.29<br>1.50<br>1.57 | 1.2<br>5.8<br>6.6 | 1.34 | 1.1 | LNT | 1.50 | >5.6 | 1.18 | 1.56(RT)<br>1.84(LHeT) |

UNDULATOR

This application is the U.S. National Phase under 35 U.S.C. §371 of International Application PCT/JP2005/000525, filed Jan. 18, 2005, which claims priority to Japanese Patent Application No. 2004-015878, filed Jan. 23, 2004. The International Application was not published under PCT Article 21(2) in English.

TECHNICAL FIELD

The present invention relates to an undulator comprising a first magnetic circuit for forming a periodic magnetic field, a first support body for supporting the first magnetic circuit, a second magnetic circuit arranged opposite to the first magnetic circuit, for forming a periodic magnetic field, a second support body for supporting the second magnetic circuit, a space formed between the oppositely arranged first and second magnetic circuits, for passing an electron beam, and a vacuum chamber for in-vacuuming the first magnetic circuit and the second magnetic circuit.

BACKGROUND ART

When an electron beam accelerated to about the speed of light in vacuum is bended in a magnetic field, radiation is emitted in a tangential direction of a traveling track of the electron beam and this is called a synchrotron radiation. The study for practical use of various techniques using characteristics such as high orientation, high intensity, high polarization by setting a light source that generates this synchrotron radiation at a straight section of an electron storage ring. In the electron storage ring of nowadays, many undulators that are high-intensity light sources each having a smaller beam section and higher beam directivity are provided.

This undulator adopts a construction in which a first magnetic circuit and a second magnetic circuit are oppositely arranged through a space to form a periodic magnetic field through which an electron beam passes as shown in the following Japanese Unexamined Patent Publication No. 2000-206296 or In-vacuum undulators of SPring-8, T. Hara, T. Tanaka, T. Tanabe, X. M. Marechal, S. Okada and H. Kitamura: J. Synchrotron Radiation 5, 403 (1998) and Construction of an in-vacuum undulator for production of undulator x-rays in the 5-25 KeV region. S. Yamamoto, T. Shioya, M. Hara, H. Kitamura, X. W. Zhang, T. Mochizuki, H. Sugiyama and M. Ando; Rev. Sci. Instrum. 61 (1992) 400. In order to generate the periodic magnetic field, each of the first and second magnetic circuits includes many arranged permanent magnets. When a strong magnetic field is to be generated, the first magnetic circuit and the second magnetic circuit are to be brought close to each other, so that an interval (gap) of the space can be narrowed and the magnetic field is intensified. Thus, a construction in which the first magnetic circuit and the second magnetic circuit are contained in a vacuum chamber is adopted. In this construction, there is an advantage such that the gap can be narrowed as compared with a construction in which a vacuum chamber is provided between a first magnetic circuit and a second magnetic circuit.

However, even when the gap is narrowed as described above, there is a limit in characteristics of the permanent magnet. In addition, when the gap is narrowed too much, there arises a new problem such that the permanent magnet is demagnetized due to radiation generated when the electron beam impinges on the permanent magnet. Therefore, there is a limit of intensifying the magnetic field only by a method of narrowing the gap.

DISCLOSURE OF THE INVENTION

Problem to be Solved by the Invention

The present invention is made in view of the above circumstances and it is an object of the present invention to provide an undulator in which a magnetic field formed in a space can be intensified and radiation-proof characteristics are improved in a case where a first magnetic circuit and a second magnetic circuit are oppositely arranged with the space therebetween.

Means for Solving the Problem

An undulator according to the present invention to solve the above problems is characterized by including:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for vacuum-sealing the first magnetic circuit and the second magnetic circuit; and a cooling mechanism for cooling a permanent magnet constituting the first magnetic circuit and the second magnetic circuit below the room temperature.

Hereinafter, a description will be made of a function and an effect of the undulator having the above construction. In order to form a periodic magnetic field, the first magnetic circuit and the second magnetic circuit are arranged oppositely with the space therebetween. The first magnetic circuit is supported by the first support body and the second magnetic circuit is supported by the second support body. The first and second magnetic circuits are in-vacuumed in the vacuum chamber. When an electron beam is passed through the space in which the periodic magnetic field is generated, the synchrotron radiation can be generated. Each of the first and second magnetic circuits includes permanent magnets and the cooling mechanism for cooling the permanent magnet below the room temperature. When the permanent magnet is cooled, there appear characteristics in which a remanent flux density (Br) and magnetic coercive force (designated by iHc which is a value of H when an I-H curve (demagnetization curve) crosses an H axis and called intrinsic magnetic coercive force) are increased. When the remanent flux density is increased, magnetic characteristics are improved, so that an intense magnetic field can be formed in the space. In addition, when the magnetic coercive force is increased, it is known that radiation-proof characteristics are improved. As a result, when the first magnetic circuit and the second magnetic circuit are formed oppositely with the space therebetween, there can be provided an undulator in which the magnetic field formed in the space can be intensified and the radiation-proof characteristics can be improved.

Conventionally, the magnetic circuit is cooled by circulating hot water having a temperature about 120° C. in a baking process so that the permanent magnet may not be heated up to a predetermined temperature or more, and by circulating cooling water having a temperature about the room temperature so that the temperature of the magnetic circuit may not become unstable by the heat from the electron beam when the magnetic circuit is used.

Preferably, the undulator according to the present invention further includes:

an gap changing mechanism for changing an gap of the space;

a refrigerant passing tube provided in the cooling mechanism, for passing a refrigerant; and a connecting component for connecting the refrigerant passing tube to each of the first support body and the second support body, in which the connecting component has flexibility and allows the gap changing mechanism to change the gap.

By providing the gap changing mechanism, the gap of the space can be changed, so that the intensity of the magnetic field can be adjusted. In addition, the magnetic circuit can be easily assembled when it is incorporated. As the cooling mechanism, the refrigerant passing tube for passing the refrigerant is provided and this is connected to the first support body and the second support body by the connecting component. Therefore, the magnetic circuit supported by the support body can be cooled through the connecting component. Furthermore, since the connecting component has flexibility, even when the gap of the space is changed (even when the first and second support bodies are moved) with the refrigerant passing tube fixed, movement is easy.

Another cooling mechanism according to the present invention preferably includes:

a first refrigerant passing tube provided to cool the first magnetic circuit, for passing the refrigerant; and a second refrigerant passing tube provided to cool the second magnetic circuit, for passing the refrigerant, in which the first refrigerant passing tube is fixed to the first support body and the second refrigerant passing tube is fixed to the second support body.

In this case, the first refrigerant passing tube is fixed to the first support body and the second refrigerant passing tube is fixed to the second support body. Thus, the magnetic circuit supported by the support body can be cooled. In addition, according to this construction, when the first and second support bodies are moved, since the refrigerant passing tube fixed to each support body is moved together, a connecting component having flexibility is not necessary.

A still another cooling mechanism according to the present invention preferably includes:

a first refrigerant passing tube provided to cool the first magnetic circuit, for passing the refrigerant; and a second refrigerant passing tube provided to cool the second magnetic circuit, for passing the refrigerant, in which the first refrigerant passing tube penetrates the inside of the first support body and the second refrigerant passing tube penetrates the inside of the second support body.

Since the refrigerant passes through inside of the support body, the magnetic circuit can be efficiently cooled.

Preferably, the undulator according to the present invention includes an gap changing mechanism for changing an gap of the space;

a cooling head provided in the cooing mechanism and cooled by a freezing machine, and a connecting component for connecting the cooling head to each of the first support body and the second support body, in which the connecting component has flexibility and allows the gap changing mechanism to change the gap.

Although the example in which the cooling mechanism includes the refrigerant passing tube was described above, the cooling mechanism may includes the freezing machine. In this case, the cooling heads of the freezing machines are connected to the first support body and the second support body through the connecting components. In this case, since the connecting component has flexibility, when the gap of the space is changed, the connecting component can easily follow it.

According to the present invention, a hollow part is preferably formed in each of a first support shaft for supporting the first support body and a second support shaft for supporting the second support body.

When the cooling mechanism for cooling the magnetic circuit is provided, it is necessary to prevent heat from being transferred from the outside of the undulator. Since the support shafts for supporting the first and second support bodies need to be strong, it is formed of metal. However, metal has high thermal conductivity, and therefore the heat from the outside is likely to be transferred. Thus, the support shaft is made hollow, so that the heat is not likely to be transferred. As a result, the magnetic circuit can be set at a desired cooling temperature.

According to the present invention, it is preferable to provide a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors.

When the permanent magnet is cooled, there is a permanent magnet which shows characteristics in which the remanent flux density is increased as the temperature is lowered, but when the temperature is lowered to a certain temperature or less, the remanent flux density is reduced. Therefore, when the magnetic circuit includes the permanent magnet, it is necessary to control the cooling temperature. Thus, since the heater for heating the magnetic circuit, the temperature sensor for detecting the temperature of the magnetic circuit, and the temperature control unit for controlling the heater are provided, the cooling temperature can be appropriately controlled.

According to the present invention, it is preferable that each of the first support body and the second support body has a holder for mounting the permanent magnet, and a holder support for supporting the holder, and a material of the holder has a thermal expansion coefficient greater than or equal to that of the holder support.

A process for assembling the permanent magnet in the holder is performed at the room temperature, and when the undulator is actually operated, the temperature is cooled to a desired temperature. In this case, when the material of the holder support has a thermal expansion coefficient greater than that of the holder, the holder is deformed due to a difference in thermal expansion coefficient when cooled, which causes a damage of the magnetic circuit. Thus, the holder and the holder support are formed of the same material (having the same thermal expansion coefficient) or the holder is formed of the material having a thermal expansion coefficient greater than that of the holder support, so that the holder is not deformed due to a difference in thermal expansion coefficient.

BRIEF DESCRIPTION OF THE DRAWINGS

FIG. 14 is a view showing a concrete example of permanent magnets.

BEST MODE FOR CARRYING OUT THE INVENTION

Figure 1:
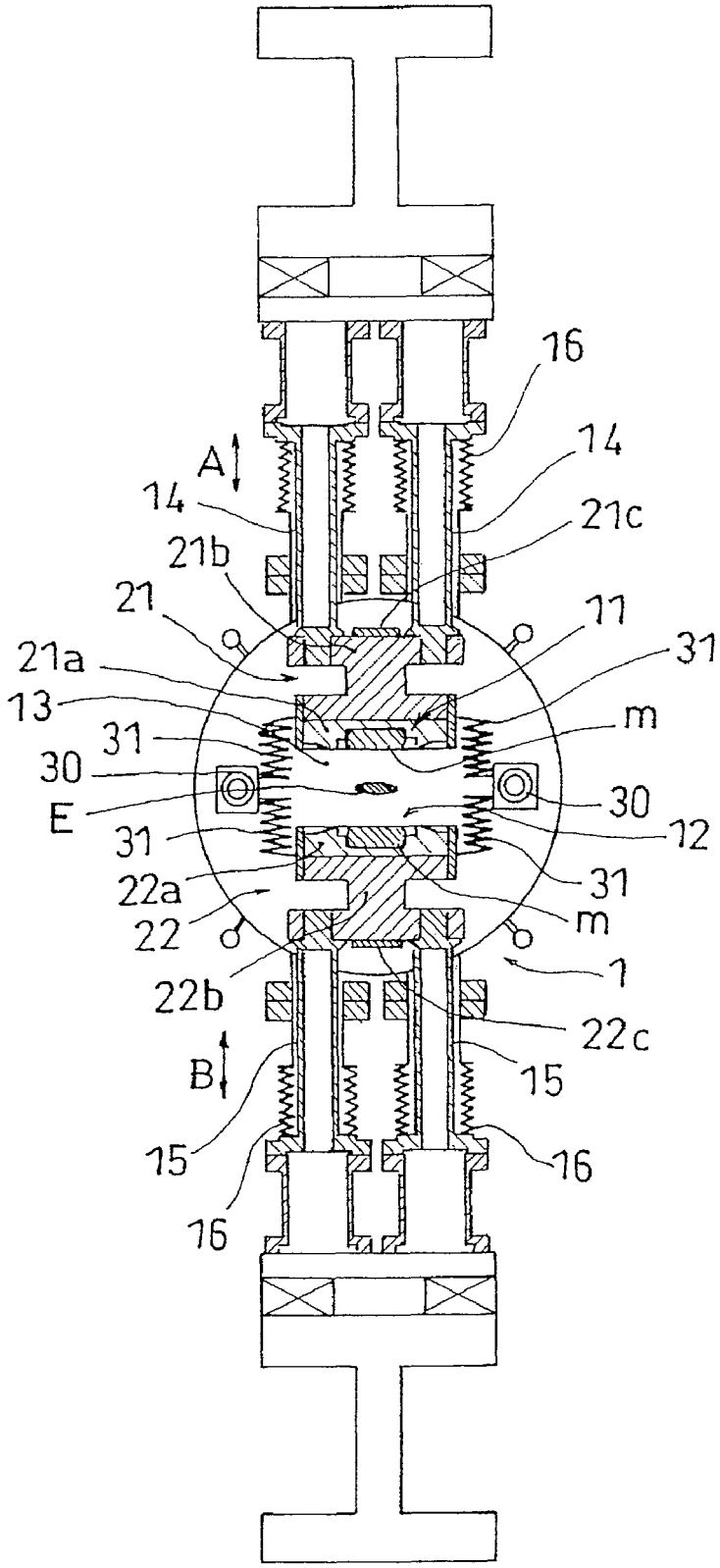
FIG. 1 is a transverse sectional view showing an undulator according to a first embodiment.
Figure 2:
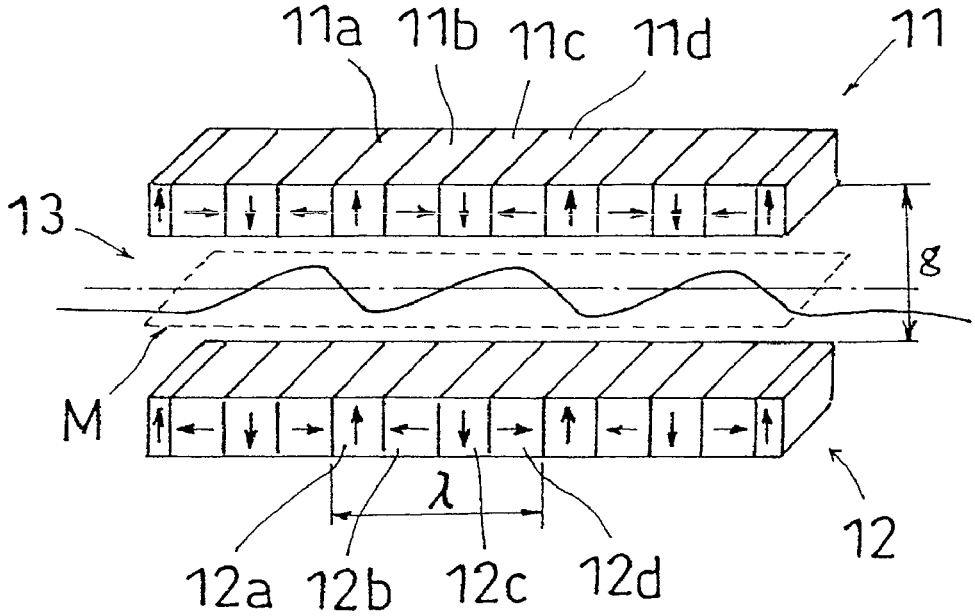
FIG. 2 is a view showing a construction of a magnetic circuit.
Figure 3:
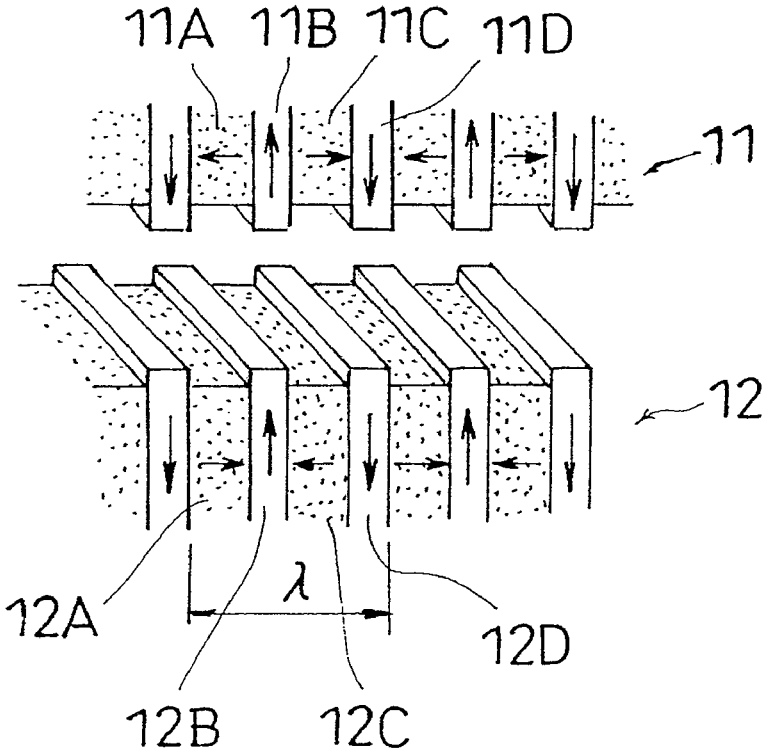
FIG. 3 is a view showing another construction of the magnetic circuit.

Preferred embodiments of an undulator according to the present invention will be described with reference to the drawings. FIG. 1 is a transverse sectional view showing an undulator according to a first embodiment. FIG. 2 is a conceptual view showing a construction of a magnetic circuit. FIG. 3 is a conceptual view showing another construction of the magnetic circuit.

First, a description will be made of the magnetic circuit. FIG. 2 shows a so-called Halbach type of magnetic circuit, in which a first magnetic circuit 11 and a second magnetic circuit 12 are disposed with a space 13 therebetween. The first magnetic circuit 11 includes many groups of four permanent magnets 11*a* to 11*d* which are arranged in a traveling direction of an electron beam. A magnetization direction of each of the permanent magnets 11*a* to 11*d* is shown by an arrow. The second magnetic circuit 12 also comprises many groups of four permanent magnets 12*a* to 12*d* which are arranged in the traveling direction of the electron beam. Thus, "λ" designates a period of a magnetic field as shown in the drawing. An arrangement pitch of this magnet can be changed appropriately according to its purpose.

A gap of the space 13 is designated by "g". This gap "g" can be changed by a gap changing mechanism. By changing the gap, intensity of the magnetic field can be adjusted. When the permanent magnets are arranged as shown in FIG. 2, a periodic magnetic field can be formed in the space 13. When the electron beam is passed through the space 13, the electron beam is affected by the periodic magnetic field and goes through like snake. A weaving surface M of the electron beam is parallel to magnet surfaces of the opposed first and second magnetic circuits. When the electron beam weays through it, a desired synchrotron radiation can be generated.

Although the magnetic circuit shown in FIG. 2 is constituted by the permanent magnets only, a soft magnet is disposed between permanent magnets in a so-called hybrid type of magnetic circuit as shown in FIG. 3. That is, a first magnetic circuit includes permanent magnets 11A and 11C and soft magnetic material 11B and 11D which are alternatively arranged, and a second magnetic circuit includes permanent magnets 12A and 12C and soft magnetic material 12B and 12D which are alternately arranged. Each magnetization direction (direction of a magnetic flux) is shown by an arrow. According to the undulator of the present invention, any magnetic circuit may be used and it is not limited to a magnetic circuit having a specific construction.

First Embodiment

Next, a description will be made of a construction of the undulator according to a first embodiment. FIG. 1 is the transverse sectional view showing the undulator cut along a surface perpendicular to the traveling direction of the electron beam. The first magnetic circuit 11 and the second magnetic circuit 12 are oppositely arranged with the space 13 therebetween. As described above with reference to FIG. 2, according to the first magnetic circuit 11, many permanent magnets "m" are arranged along the traveling direction of the electron beam (direction perpendicular to a sheet surface of FIG. 1). Similarly, many permanent magnets "m" are arranged in the second magnetic circuit 12. A concrete example of a preferred permanent magnet "m" will be described below.

A first support body 21 is provided to mount and support the first magnetic circuit 11. The first support body 21 includes a first magnet holder 21*a* (corresponding to a holder) and a first magnet mounting beam 21*b* (corresponding to a holder support). Conventionally, since the temperature is heated up to a high temperature in a baking process, the first magnet holder 21*a* is formed of oxygen free copper and the first magnet mounting beam 21*b* is formed of aluminum. However, according to the present invention, both are formed of oxygen free copper. As will be described below, when the magnetic circuits 11 and 12 are cooled, although both magnet holder 21*a* and the magnet mounting beam 21*b* shrink, since they are formed of the same material, the magnet holder 21*a* is not deformed by the shrinkage in size. Therefore, even when the magnetic circuits 11 and 12 are cooled, the permanent magnet "m" is not deformed and not damaged.

In addition, the first magnet holder 21*a* may be formed of aluminum and the first magnet mounting beam 21*b* may be formed of oxygen free copper. In this case also, since a thermal expansion coefficient of aluminum is higher than that of oxygen free copper, even when the magnetic circuits 11 and 12 are cooled, they are not deformed in a damaging direction.

A second support body 22 for mounting and supporting the second magnetic circuit 12, and a second magnet holder 22*a* and a second magnet mounting beam 22*b* are similar to those of the first magnetic circuit 11.

Hereinafter, a description will be made of a construction of a cooling mechanism to cool the magnetic circuits 11 and 12. There is provided a refrigerant passing tube 30 through which a refrigerant is passed, that is, a pair of refrigerant passing tubes 30 are provided on both lateral sides of the space 13. Although the refrigerant is not limited to a specific one, it is preferable that the refrigerant is a liquefied refrigerant such as liquid nitrogen or liquid helium. The refrigerant passing tube 30 is also arranged in the traveling direction of the electron beam. The refrigerant is circulated through a predetermined circulation path.

The refrigerant passing tube 30 and each of the first and second support bodies 21 and 22 are connected through connecting components 31. The connecting component 31 has a configuration having flexibility (which can be accordion-folded as shown in the drawing below), so that even when the first and second support bodies 21 and 22 are vertically moved, the connection state between each of the first and second support bodies 21 and 22 and the refrigerant passing tube 30 can be maintained. The connecting component 31 is formed of a conductor having high thermal conductivity (copper (oxygen free copper or beryllium copper) and aluminum, for example). In addition, the refrigerant passing tube 30 is fixed.

Although the connecting component 31 is made flexible for the above reason, it is made flexible with the purpose of further providing thermal resistance to some extent. When the thermal resistance is provided, temperature control can be performed with higher precision as will be described below.

When the magnetic circuits 11 and 12 are cooled by the cooling mechanism so that their temperatures are set so as to be not more than the room temperature but not less than that of the liquid nitrogen or liquid helium. The temperature to be set varies according to a kind of refrigerant to be used or a kind of permanent magnet "m" which constitutes the magnetic circuits 11 and 12.

Hereinafter, a description will be made of an effect provided by cooling the permanent magnet "m". As general characteristics of the permanent magnet, a remanent flux density "Br" becomes high as the permanent magnet is cooled. By using this characteristics, a strong magnetic field can be generated in the space 13. In addition, when the permanent magnet is cooled, its magnetic coercive force is increased. Thus, its radiation-proof characteristics are enhanced. Furthermore, when the permanent magnet is cooled, desorption of a gas molecule from a surface of the permanent magnet in a vacuum chamber 1 is reduced. Therefore, ultrahigh vacuum can be implemented in the vacuum chamber 1 without performing the baking process for the magnetic circuits 11 and 12. Although they are heated up to a predetermined temperature when the baking process is performed, a problem such as heat demagnetization is generated when the permanent magnet is heated. Therefore, conventionally, it is necessary to select a material having high magnetic coercive force and a low remanent flux density at the room temperature for the permanent magnet in view of the heat demagnetization in the baking process. However, according to the present invention, since it is not necessary to consider such heat demagnetization, a material having low magnetic coercive force and a high remanent flux density at the room temperature can be selected, so that a strong magnetic field can be generated in the space 13.

The first and second magnetic circuits 11 and 12 are in-vacuumed in the vacuum chamber 1. When the magnetic circuits 11 and 12 are in-vacuumed in the vacuum chamber 1, the gap "g" can be small. In addition, since a heat shielding effect can be provided when they are in-vacuumed, the heat in a room where the undulator R is set can be prevented from being transferred to the magnetic circuits 11 and 12 through the vacuum chamber 1.

The first and second support bodies 21 and 22 supporting the first and second magnetic circuits 11 and 12, respectively can be moved vertically (shown by arrows A and B in FIG. 1) by the gap changing mechanism (not shown). As the gap changing mechanism, the mechanism disclosed in the above-described Japanese Unexamined Patent Publication No. 2000-206296 or In-vacuum undulators of SPring-8, T. Hara, T. Tanaka, T. Tanabe, X. M. Marechal, S. Okada and H. Kitamura: J. Synchrotron Radiation 5, 403 (1998) can be used, for example. The gap "g" of the space 13 can be changed by the gap changing mechanism. By changing the gap "g", the intensity of the magnetic field in the space 13 can be adjusted as desired.

An upper part of the first support body 21 is supported by a first support shaft 14. The first support shaft 14 is formed of metal and its inside is hollow. Since almost an entire part of the first support shaft 14 is disposed outside the vacuum chamber 1, the heat of the room (outside the vacuum chamber) is transferred to the first support shaft 14 to raise a temperature of the first magnetic circuit 11. In order to prevent such temperature raise as much as possible, the first support shaft 14 is made hollow to prevent the temperature from being transferred. A lower part of the second support body 22 is also supported by a second support shaft 15 and its inside is hollow for the same reason as the above. Thus, while the support shafts 14 and 15 are kept strong, thermal conductivity thereof is lowered. A bellows 16 is provided around each of the support shafts 14 and 15, so that while the vacuum chamber 1 is held with vacuum, the support shafts 14 and 15 can be vertically moved.

Since the undulator is set in the room at the room temperature, it is necessary to avoid the radiation heat from infrared rays and the like as much as possible. Although the magnetic circuits 11 and 12 are vacuum-insulated by the vacuum chamber 1, the magnetic circuits 11 and 12 could not be sufficiently cooled due to the radiation heat. Thus, it is necessary to provide measures to reflect the heat. For example, it is preferable that surfaces of the magnet holders 21*a* and 22*a* and the magnet mounting beams 21*b* and 22*b* of the support bodies 21 and 22, are respectively plated with gold so that they can reflect the radiation heat.

Figure 4:
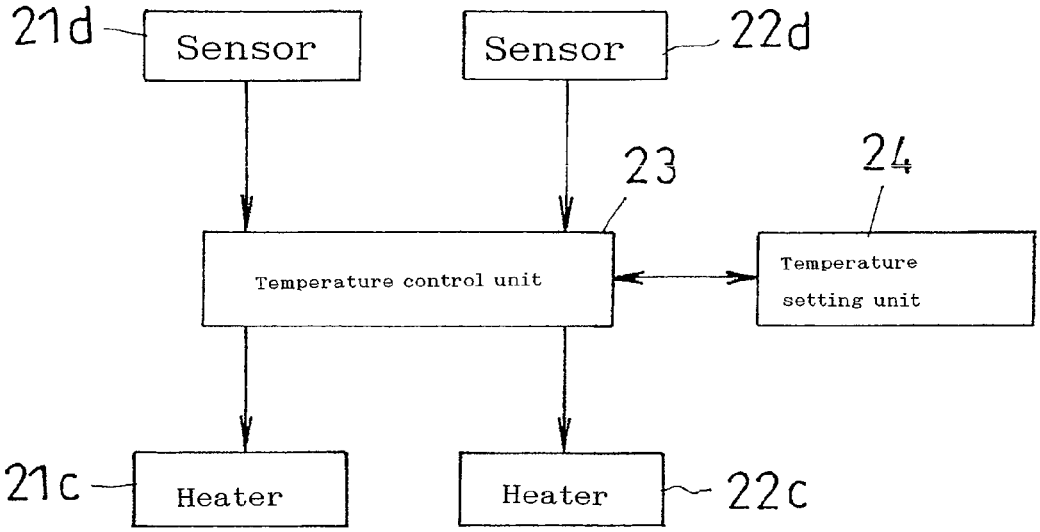
FIG. 4 is a view showing a control block diagram regarding temperature control.

A first heater 21*c* is provided on a back surface of the first magnet mounting beam 21*b* of the first support body 21. Similarly, a second heater 22*c* is provided in the second support body 22. In addition, temperature sensors 21*d* and 22*d* are buried in the first and second magnet mounting beams 21*b* and 22*b*, respectively (not shown in FIG. 1). FIG. 4 is a control block diagram showing a construction of a temperature control unit 23. Temperature data to control cooling of the permanent magnet is set in a temperature setting unit 24. The temperature control unit 23 compares temperature data measured by the temperature sensors 21*d* and 22*d* with the set temperature data and controls the heaters 21*c* and 22*c* separately so that the temperature may become a desired temperature.

As the heater, a sheath heater can be used, for example. The heaters 21*c* and 22*c* are mounted such that they are pressed onto the back sides of the magnet mounting beams 21*b* and 22*b* by a copper plate and the like and screwed, respectively. As the temperature sensor, a temperature measuring resistor or a thermocouple using platinum may be used.

Figure 5:
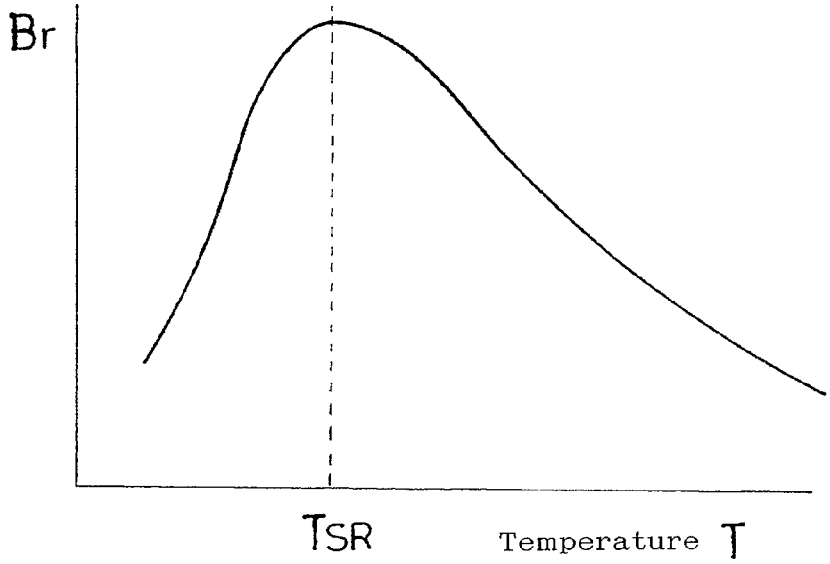
FIG. 5 is a graph showing characteristics of a magnet.

Although the temperature control unit 23 is not always necessary, it is preferably provided in the following case. There is no problem in a case where as the characteristics of the permanent magnet, the magnetic characteristics is enhanced as the temperature of the permanent magnet is lowered, but there is a permanent magnet material which remanent flux density shows a peak value at a specific low temperature as shown in FIG. 5. For example, in a case where the permanent magnet is a rare earth-iron-boron magnet which causes spin reorientation at a temperature of TSR (spin reorientation temperature) or less, it is necessary to control the temperatures of the magnetic circuits 11 and 12 so that they may not be cooled to the TSR or less.

Second Embodiment

Figure 6:
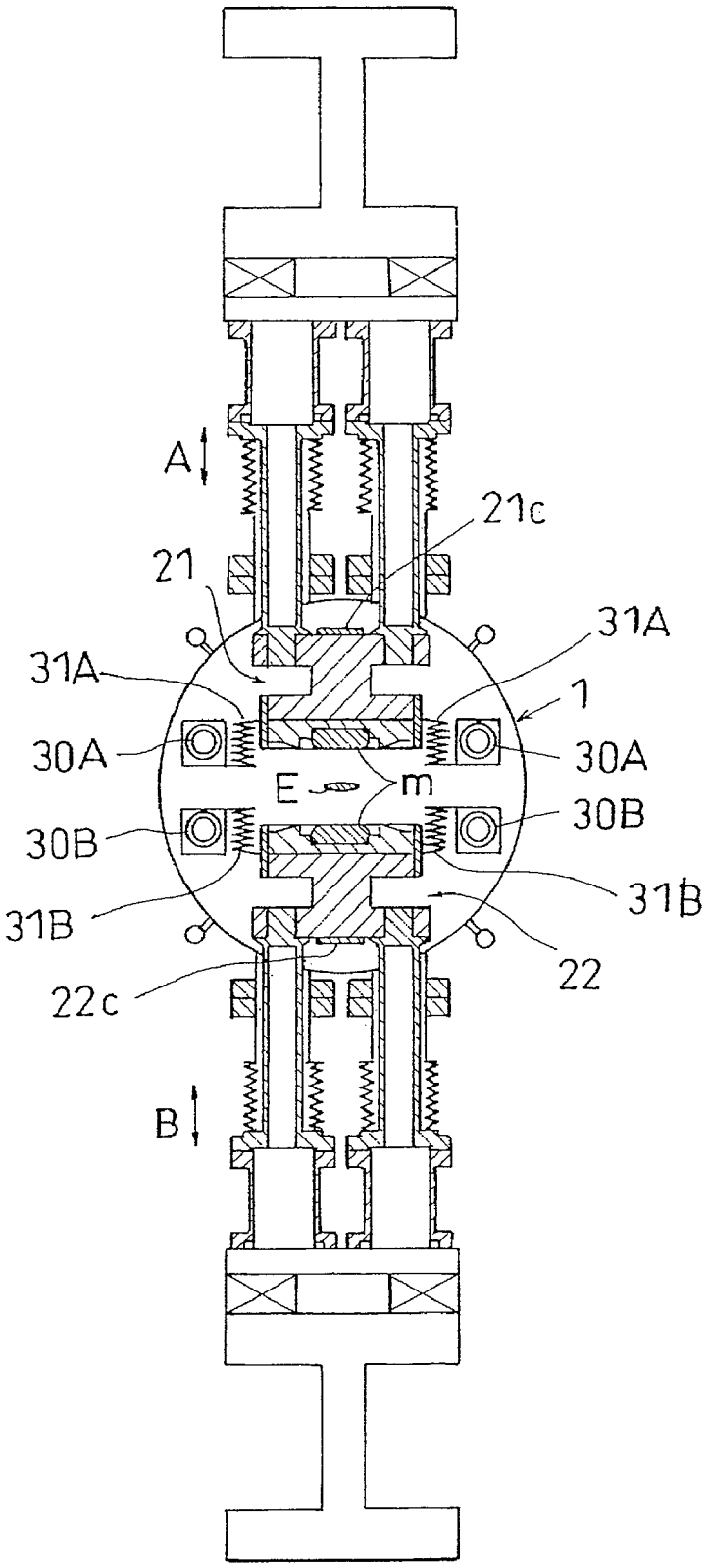
FIG. 6 is a transverse sectional view showing an undulator according to a second embodiment.

Hereinafter, a description will be made of an undulator according to a second embodiment with reference to FIG. 6. The same reference numbers are allotted to the components having the same functions as those in the first embodiment and their descriptions will not be repeated.

According to the second embodiment, a pair of first refrigerant passing tubes 30A and a pair of second refrigerant passing tubes 30B are provided and each first refrigerant passing tube 30A is connected to a first support body 21 through a connecting component 31A. Similarly, each second refrigerant passing tube 30B is connected to a second support body 22 through a connecting component 31B. Each of the connecting components 31A and 31B has flexibility. Thus, although each of the refrigerant passing tubes 30A and 30B is fixed to a vacuum chamber 1, even when the first and second support bodies 21 and 22 are vertically moved, connecting states between the support bodies 21 and 22 and the refrigerant passing tubes 30A and 30B can be maintained, respectively.

Third Embodiment

Figure 7:
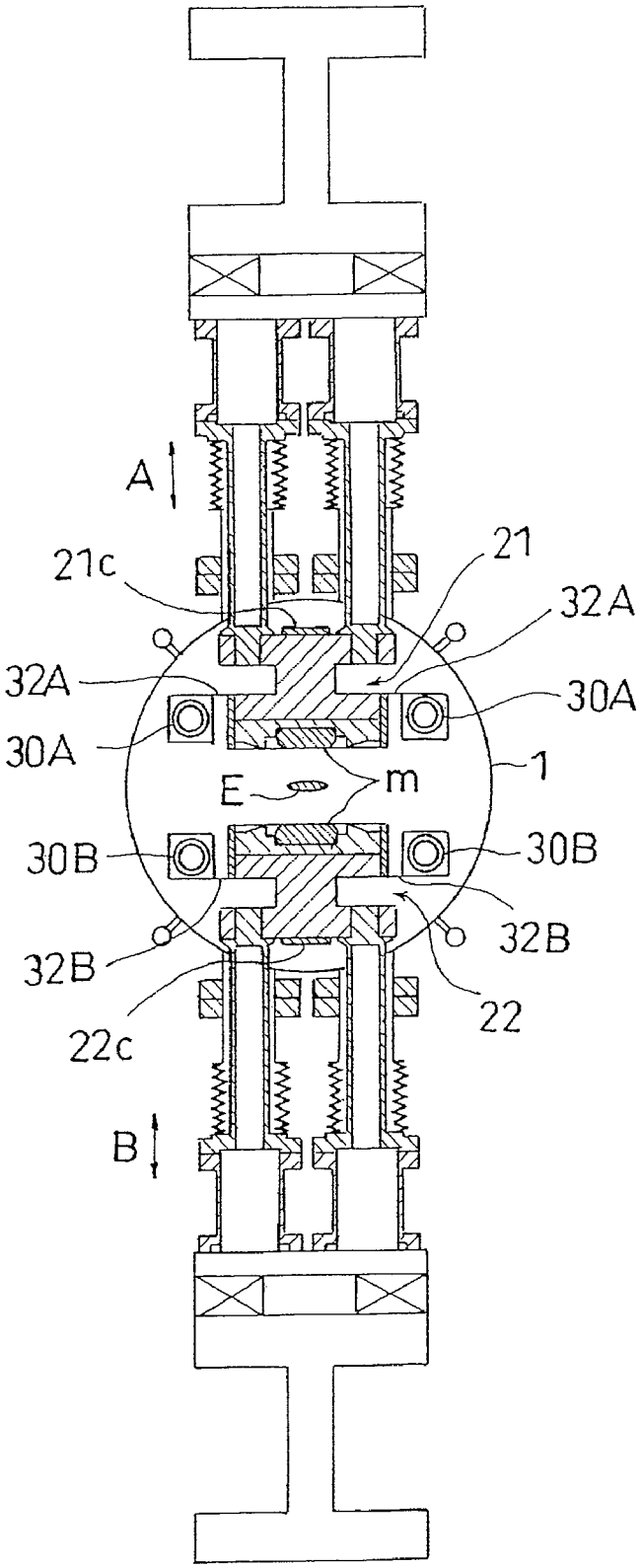
FIG. 7 is a transverse sectional view showing an undulator according to a third embodiment.

Hereinafter, a description will be made of an undulator according to a third embodiment with reference to FIG. 7. This embodiment is different from the second embodiment in that first and second refrigerant passing tubes 30A and 30B are fixed to first and second support bodies 21 and 22 through fixing units 32A and 32B. The fixing units 32A and 32B are formed of metal plate (such as a copper plate (beryllium copper and equivalent), a stainless plate or an aluminum plate). When the first support body 21 and the second support body 22 are vertically moved, the first refrigerant passing tube 30A and the second refrigerant passing tube 30B are also vertically moved, respectively. Therefore, a connecting component having flexibility is not used. In addition, when it is necessary for the fixing units 32A and 32B to have thermal resistance, it is preferable that those are formed of the stainless plate.

Fourth Embodiment

Figure 8:
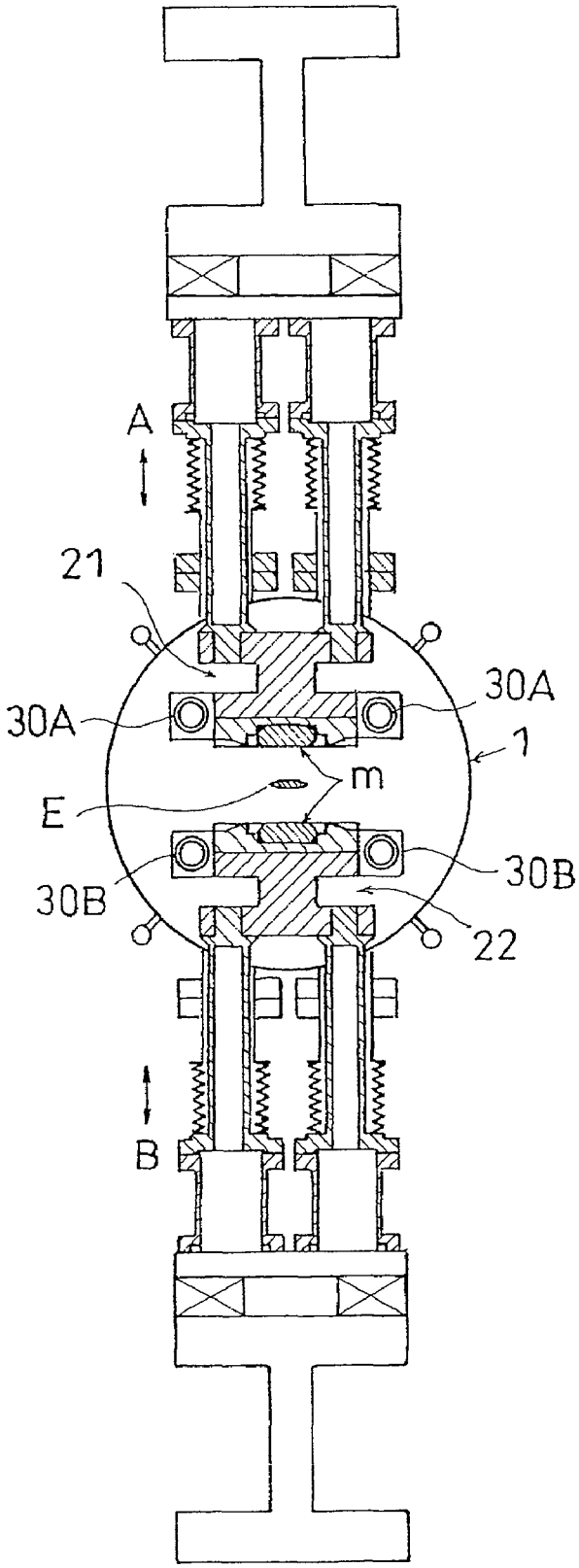
FIG. 8 is a transverse sectional view showing an undulator according to a fourth embodiment.

Hereinafter, a description will be made of an undulator according to a fourth embodiment with reference to FIG. 8. This embodiment is different from the third embodiment in that first and second refrigerant passing tubes 30A and 30B are directly fixed to side surfaces of first and second support bodies 21 and 22, respectively. The fixing unit shown in the third embodiment is not provided. Similar to the third embodiment, when the first support body 21 and the second support body 22 are vertically moved, the first refrigerant passing tube 30A and the second refrigerant passing tube 30B are also vertically moved, respectively. Therefore, a connecting component having flexibility is not used. Since the refrigerant passing tubes 30A and 30B are directly mounted on the support bodies 21 and 22, respectively, a cooling process can be efficiently performed. In addition, although a heater is not provided in the fourth embodiment, a temperature can be controlled by varying the temperature of a refrigerant. This is similar to the next fifth embodiment.

Fifth Embodiment

Figure 9:
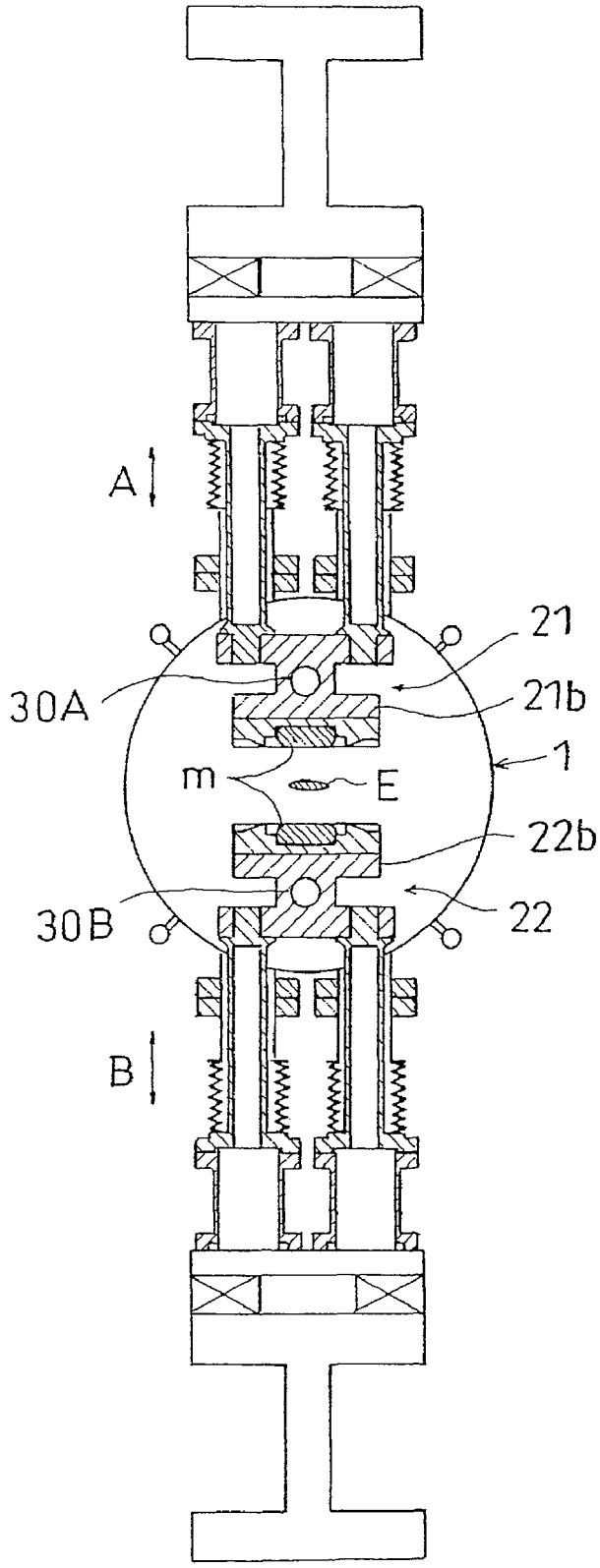
FIG. 9 is a transverse sectional view showing an undulator according to a fifth embodiment.

Hereinafter, a description will be made of an undulator according to a fifth embodiment with reference to FIG. 9. According to this embodiment, a first refrigerant passing tube 30A is buried in a first magnet mounting beam 21*b* of a first support body 21. A second refrigerant passing tube 30B is similarly buried in a second magnet mounting beam 22*b*. When the first and second support bodies 21 and 22 are vertically moved, the first and second refrigerant passing tubes 30A and 30B are moved together, respectively. Since the refrigerant passing tubes 30A and 30B are buried in the support bodies 21 and 22, respectively, a cooling process can be efficiently performed.

Sixth Embodiment

Figure 10:
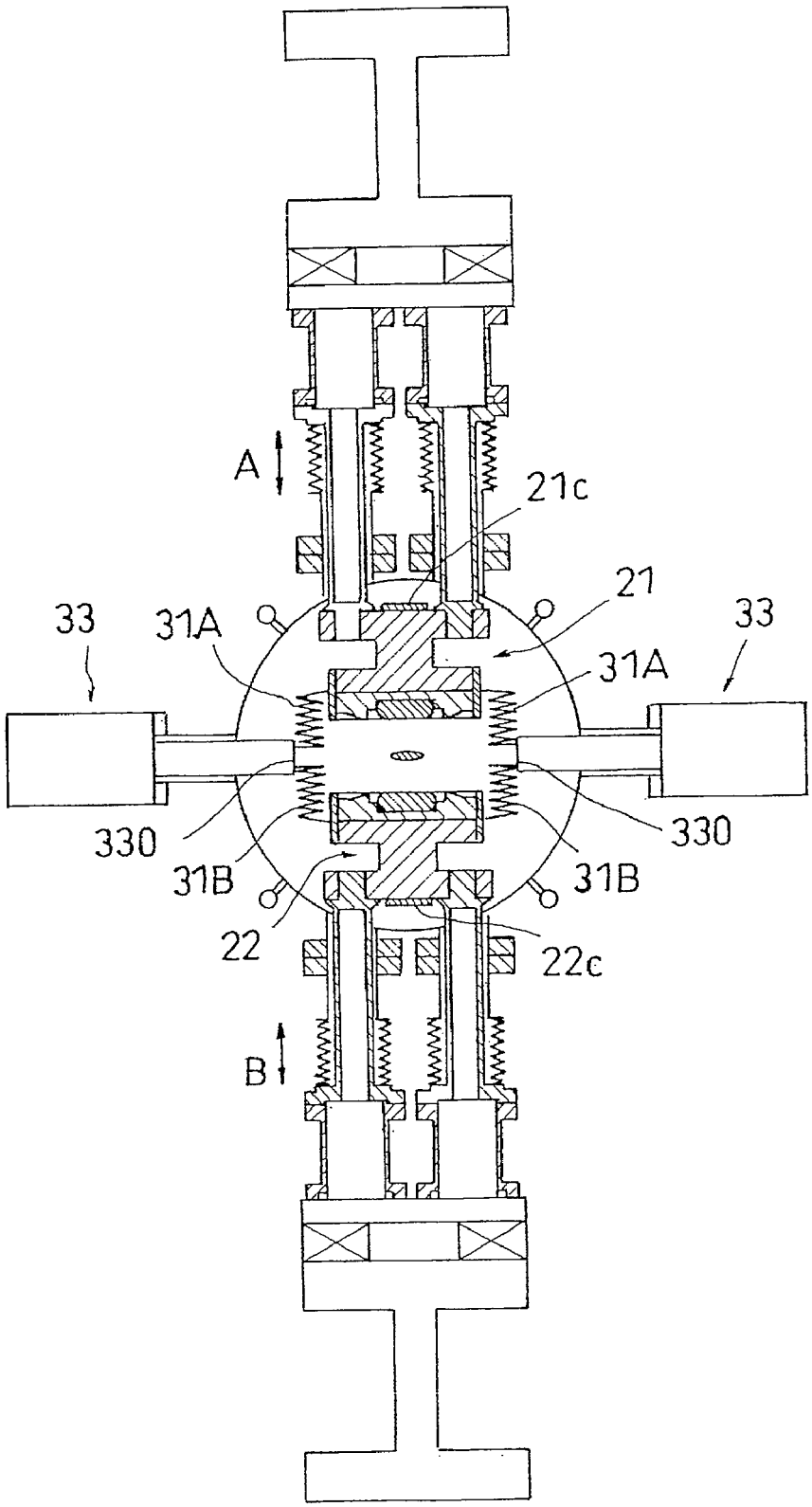
FIG. 10 is a transverse sectional view showing an undulator according to a sixth embodiment.

Hereinafter, a description will be made of an undulator according to a sixth embodiment with reference to FIG. 10. According to embodiments after FIG. 10, a cooling mechanism using a freezing machine 33 will be described. As shown in FIG. 10, a pair of freezing machines 33 is disposed on both lateral sides of a vacuum chamber 1 and a cooling head 330 is inserted into the vacuum chamber 1. An upper side of the cooling head 330 is connected to a first support body 21 by a first connecting component 31A. A lower side of the cooling head 330 is connected to a second support body 22 by a second connecting component 31B. The freezing machine 33 can cool magnetic circuits 11 and 12 based on a principle of adiabatic expansion. Similar to the first embodiment, the connecting components 31A and 31B have flexibility. Thus, even when the first and second support bodies 21 and 22 are vertically moved, the connecting states between each of the support bodies 21 and 22 and the cooling head 330 can be maintained.

Seventh Embodiment

Figure 11:
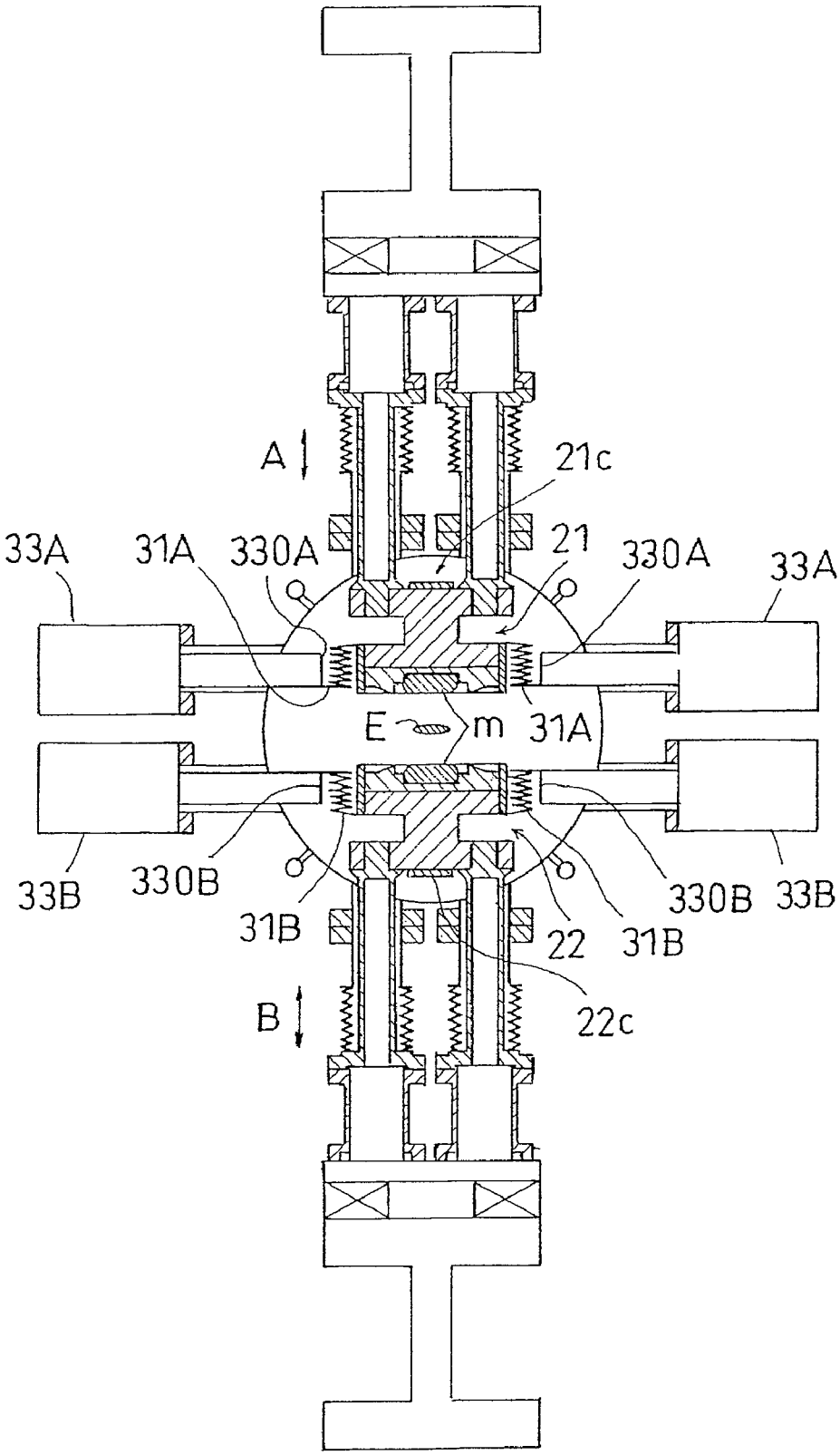
FIG. 11 is a transverse sectional view showing an undulator according to a seventh embodiment.

Hereinafter, a description will be made of an undulator according to a seventh embodiment with reference to FIG. 11. According to this embodiment, a pair of first freezing machines 33A and a pair of second freezing machines 33B are provided. A first cooling head 330A of the first freezing machine 33A is connected to a first support body 21 through a first connecting component 31A and a second cooling head 330B of the second freezing machine 33B is connected to a second support body 22 through a second connecting component 31B. The connecting components 33A and 33B have flexibility. Thus, even when the first and second support bodies 21 and 22 are vertically moved, the connecting states between each of the support bodies 21 and 22 and the cooling head 330 can be maintained.

Eighth Embodiment

Figure 12:
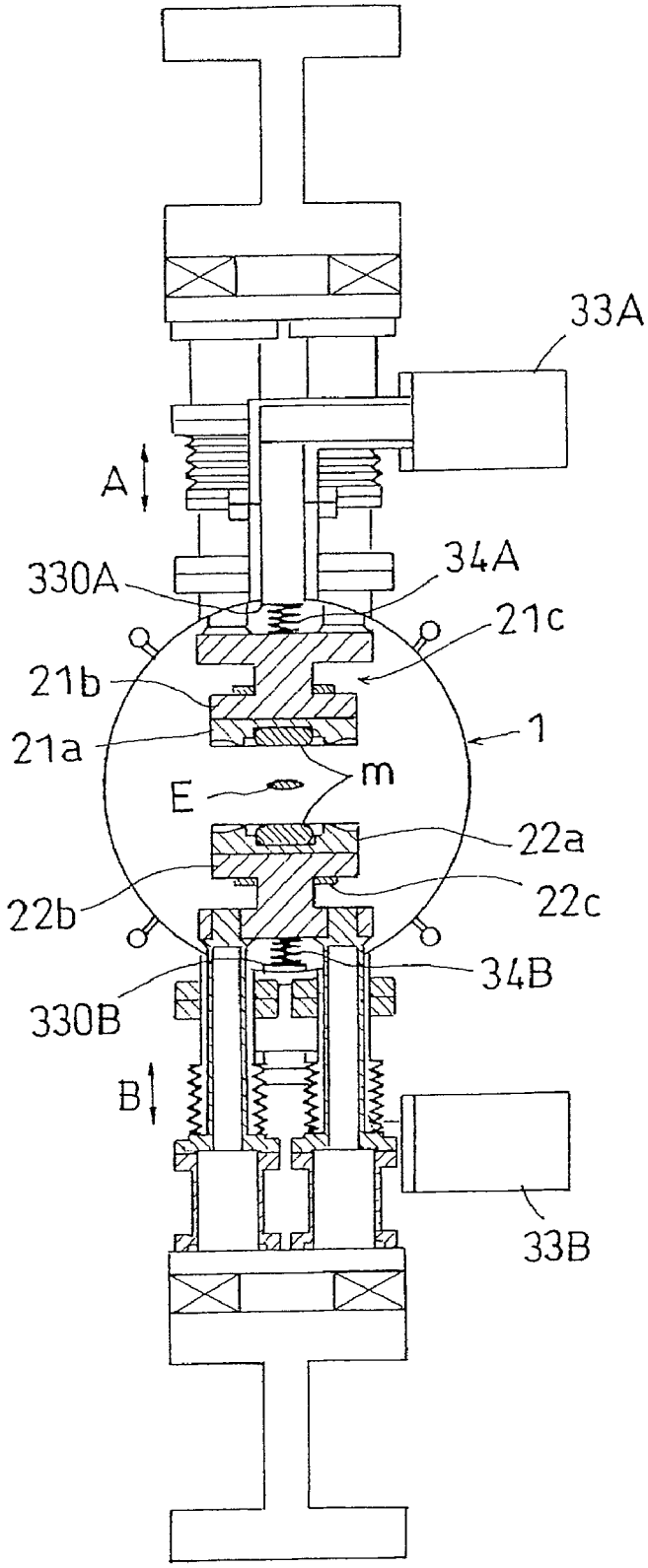
FIG. 12 is a transverse sectional view showing an undulator according to a eighth embodiment.

Hereinafter, a description will be made of an undulator according to an eighth embodiment with reference to FIG. 12. As shown in FIG. 12, a first freezing machine 33A is set above a vacuum chamber 1 and an almost L-shaped cooling head 330A is inserted into the vacuum chamber 1. An opposite side of a first magnet mounting beam 21*b* of a first support body 21 is connected to the cooling head 330A through a connecting component 34A. A first heater 21*c* is provided at a central recessed part of the first magnet mounting beam 21*b* unlike the other embodiments. A second freezing machine 33B is set below the vacuum chamber 1 and a cooling head 330B, a connecting component 34B, a second heater 22*c* and the like are arranged in the same manner. Since the connecting components 34A and 34B have flexibility, even when the first and second support bodies 21 and 22 are vertically moved, the connecting states between each of the support bodies 21 and 22 and the cooling heads 330A and 330B can be maintained.

Ninth Embodiment

Figure 13:
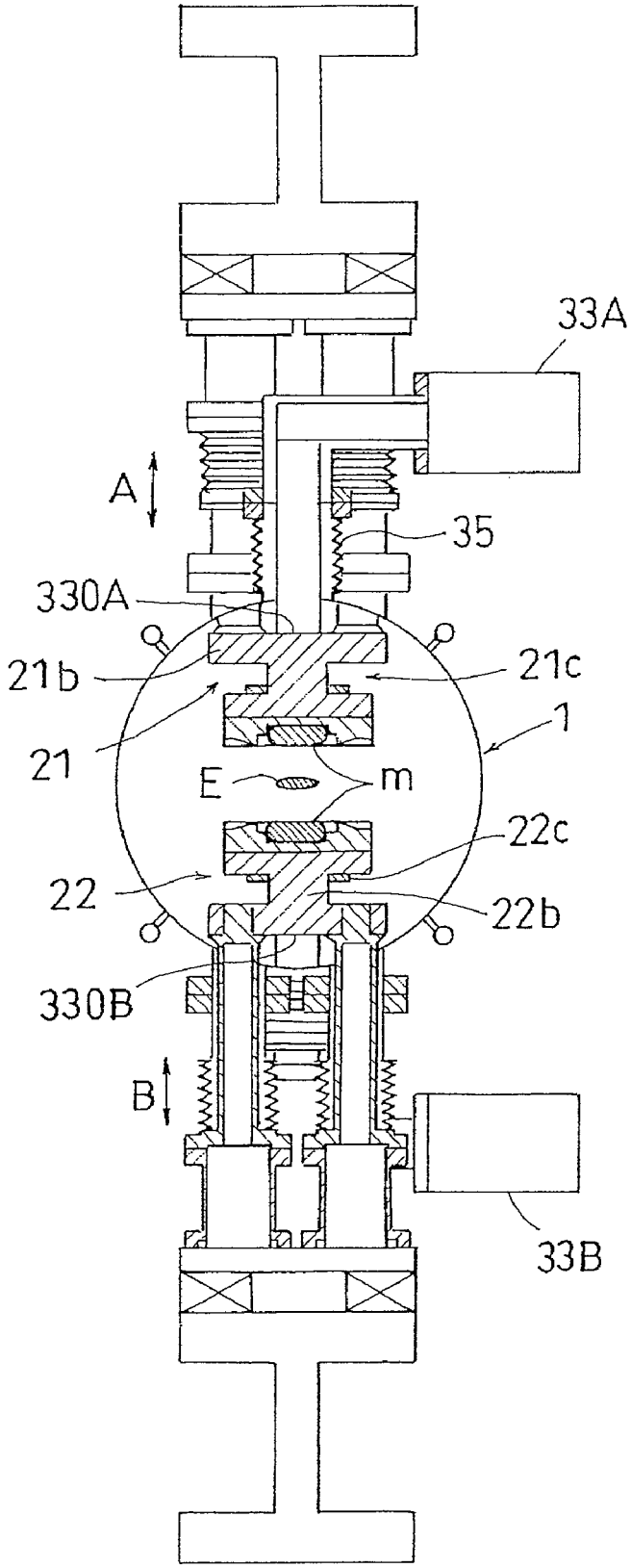
FIG. 13 is a transverse sectional view showing an undulator according to a ninth embodiment.

Hereinafter, a description will be made of an undulator according to a ninth embodiment with reference to FIG. 13. Although the arrangement of freezing machines 33A and 33B are the same as that in the eighth embodiment, the ninth embodiment is different in that edges of the cooling heads 330A and 330B are directly fixed to first and second magnet mounting beams 21*b* and 22*b*, respectively. Therefore, when the first and second support bodies 21 and 22 are vertically moved, the first freezing machine 33A and the second freezing machine 33B are also vertically moved, respectively. In addition, since a bellows 35 is provided around each of the cooling heads 330A and 330B, while the vacuum chamber 1 is held with vacuum, the cooling heads 330A and 330B can be moved vertically.

According to the ninth embodiment, when heaters are incorporated in the cooling heads 330A and 330B, a temperature can be controlled.

Concrete Example of Permanent Magnet

FIG. 14 shows a concrete example of preferred permanent magnets to constitute the magnetic circuits 11 and 12 of the undulator according to the present invention. Referring to FIG. 14, permanent magnets designated by numbers 1 to 5 are formed of Nd—Fe—B and since they provide spin reorientation, their Br (remanent flux densities) are lowered at an extremely low temperature. A permanent magnet designated by number 6 is formed of Pr—Fe—B and it does not provide the spin reorientation. A hall element was used in measuring the magnetic field. Reference character RT designates the room temperature, reference character LNT designates a liquid nitrogen temperature (77K) and reference character LHeT designates a liquid helium temperature (4.2K).

Although the hybrid type was described in FIG. 3, the soft magnet material used in this type may be permendur, Ho (holmium), Dy (dysprosium), pure iron and the like. The magnetic circuit in each embodiment may be Halbach type or hybrid type.

Effect

According to the undulator in the present invention, the following function and effect are provided. When the undulator is cooled by the cooling mechanism, the remanent flux density (Br) becomes high and the strong magnetic field can be formed in the space as compared with the case where the undulator is used at the room temperature. When the undulator is cooled, intrinsic magnetic coercive force (iHc) is increased, and radiation-proof characteristics can be enhanced accordingly. Since the magnetic circuit, the holder and holder support are cooled by the cooling mechanism, a baking process is not needed when ultrahigh vacuum is implemented. Thus, it is not necessary to consider heat demagnetization caused in the baking process and a permanent magnet having high energy product can be used.

Conventionally, when degassing from the surface of the permanent magnet is performed to provide a target vacuum degree in the vacuum chamber, in order to prevent the heat demagnetization of the permanent magnet when the permanent magnet is heated up to about 100° C. in the baking process, it is necessary to select a material having high iHc. Since the high iHc material has a low Br unconditionally because of a complementary relation, the flux density formed in the magnetic circuit is low.

Meanwhile, according to the present invention, since a gas molecule is trapped on a magnet surface when the permanent magnet is cooled, the target vacuum degree can be provided without the degassing operation in the baking process. Namely, since the magnet is not heated, it is not necessary to select the high iHc material in order to prevent the heat demagnetization. Therefore, a high Br material can be selected and since the Br is raised at a low temperature, a higher magnetic flux density can be provided.

Another Embodiment

The disclosed constructions in the above embodiments can be combined in an arbitrary manner within a rational scope.

The invention claimed is:

1. An undulator comprising:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for in-vacuuming the first magnetic circuit and the second magnetic circuit;

a cooling mechanism for cooling a permanent magnet constituting the first magnetic circuit and the second magnetic circuit below the room temperature;

a gap changing mechanism for changing a gap of the space;

a refrigerant passing tube provided in the cooling mechanism, for passing a refrigerant; and a connecting component for connecting the refrigerant passing tube to each of the first support body and the second support body, wherein the connecting component has flexibility and allows the gap changing mechanism to change the gap.

2. The undulator according to claim 1, wherein a hollow part is formed in each of a first support shaft for supporting the first support body and a second support shaft for supporting the second support body.

3. The undulator according to claim 1, wherein the cooling mechanism comprises:

a first refrigerant passing tube provided to cool the first magnetic circuit, for passing the refrigerant; and a second refrigerant passing tube provided to cool the second magnetic circuit, for passing the refrigerant, wherein the first refrigerant passing tube is fixed to the first support body and the second refrigerant passing tube is fixed to the second support body.

4. The undulator according to claim 1, wherein the cooling mechanism comprises:

a first refrigerant passing tube provided to cool the first magnetic circuit, for passing the refrigerant; and a second refrigerant passing tube provided to cool the second magnetic circuit, for passing the refrigerant, wherein the first refrigerant passing tube penetrates the inside of the first support body and the second refrigerant passing tube penetrates the inside of the second support body.

5. The undulator according to claim 1, further comprising:

a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors.

6. The undulator according to claim 1, wherein each of the first support body and the second support body has a holder for mounting the permanent magnet, and a holder support for supporting the holder, and a material of the holder has a thermal expansion coefficient greater than or equal to that of the holder support.

7. A undulator comprising:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for in-vacuuming the first magnetic circuit and the second magnetic circuit;

a cooling mechanism for cooling a permanent magnet constituting the first magnetic circuit and the second magnetic circuit below the room temperature;

a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors.

8. The undulator according to claim 7, wherein each of the first support body and the second support body has a holder for mounting the permanent magnet, and a holder support for supporting the holder, and a material of the holder has a thermal expansion coefficient greater than or equal to that of the holder support.

9. A undulator comprising:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for in-vacuuming the first magnetic circuit and the second magnetic circuit;

a cooling mechanism for cooling a permanent magnet constituting the first magnetic circuit and the second magnetic circuit below the room temperature;

a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors, wherein the cooling mechanism comprises:

a first refrigerant passing tube provided to cool the first magnetic circuit, for passing the refrigerant; and a second refrigerant passing tube provided to cool the second magnetic circuit, for passing the refrigerant, wherein the first refrigerant passing tube is fixed to the first support body and the second refrigerant passing tube is fixed to the second support body.

10. A undulator comprising:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for in-vacuuming the first magnetic circuit and the second magnetic circuit;

a cooling mechanism for cooling a permanent magnet constituting the first magnetic circuit and the second magnetic circuit below the room temperature;

a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors, wherein a hollow part is formed in each of a first support shaft for supporting the first support body and a second support shaft for supporting the second support body.

11. A undulator comprising:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for in-vacuuming the first magnetic circuit and the second magnetic circuit;

a cooling mechanism for cooling a permanent magnet constituting the first magnetic circuit and the second magnetic circuit below the room temperature;

a gap changing mechanism for changing a gap of the space;

a cooling head provided in the cooling mechanism and cooled by a freezing machine, and a connecting component for connecting the cooling head to each of the first support body and the second support body, wherein the connecting component has flexibility and allows the gap changing mechanism to change the gap.

12. The undulator according to claim 11, wherein a hollow part is formed in each of a first support shaft for supporting the first support body and a second support shaft for supporting the second support body.

13. The undulator according to claim 11, further comprising:

a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors.

14. The undulator according to claim 11, wherein each of the first support body and the second support body has a holder for mounting the permanent magnet, and a holder support for supporting the holder, and a material of the holder has a thermal expansion coefficient greater than or equal to that of the holder support.

15. A undulator comprising:

a first magnetic circuit for forming a periodic magnetic field;

a first support body for supporting the first magnetic circuit;

a second magnetic circuit arranged so as to be opposite to the first magnetic circuit, for forming a periodic magnetic field;

a second support body for supporting the second magnetic circuit;

a space formed between the oppositely arranged first and second magnetic circuits, for passing an electron beam;

a vacuum chamber for in-vacuuming the first magnetic circuit and the second magnetic circuit;

a cooling mechanism for cooling a permanent magnet constituting the first magnetic circuit and the second magnetic circuit below the room temperature;

a first temperature sensor for detecting a temperature of the first magnetic circuit;

a first heater for heating the first magnetic circuit;

a second temperature sensor for detecting a temperature of the second magnetic circuit;

a second heater for heating the second magnetic circuit; and a temperature control unit for controlling the first heater and the second heater on the basis of temperature measured data provided by the first and second temperature sensors, wherein the cooling mechanism comprises:

a first refrigerant passing tube provided to cool the first magnetic circuit, for passing the refrigerant; and a second refrigerant passing tube provided to cool the second magnetic circuit, for passing the refrigerant, wherein the first refrigerant passing tube penetrates the inside of the first support body and the second refrigerant passing tube penetrates the inside of the second support body.

* * * * *

UNITED STATES PATENT AND TRADEMARK OFFICE

CERTIFICATE OF CORRECTION

PATENT NO. : 7,872,555 B2
APPLICATION NO. : 10/597352
DATED : January 18, 2011
INVENTOR(S) : Hideo Kitamura et al.

It is certified that error appears in the above-identified patent and that said Letters Patent is hereby corrected as shown below:

At Column 2, line 1, change “20003-197144” to --2003-197144--.

At Column 2, line 7, change “couterpart” to --counterpart--.

Signed and Sealed this
Twenty-second Day of November, 2011

David J. Kappos

David J. Kappos
*Director of the United States Patent and Trademark Office*